United States Patent [19]

Hannon

[11] 4,273,031

[45] Jun. 16, 1981

[54] FLUID PRESSURE CONTAINMENT ACTUATOR

[76] Inventor: Albert H. Hannon, 805 Dorado Dr., Santa Barbara, Calif. 93111

[21] Appl. No.: 41,383

[22] Filed: May 22, 1979

[51] Int. Cl.[3] ..... F01B 29/08

[52] U.S. Cl. ..... 92/88; 104/161; 277/203

[58] Field of Search ..... 92/88; 74/566; 277/11, 277/203, DIG. 7; 104/161; 98/115 VM

[56] References Cited

U.S. PATENT DOCUMENTS

| | | | |
|---|---|---|---|
| 2,473,430 | 6/1949 | Hoffar | 92/88 |
| 3,221,610 | 12/1965 | King et al. | 92/88 X |

FOREIGN PATENT DOCUMENTS

| | | | |
|---|---|---|---|
| 669248 | 4/1952 | United Kingdom | 92/88 |

*Primary Examiner*—Irwin C. Cohen

*Attorney, Agent, or Firm*—Finnegan, Henderson, Farabow, Garrett & Dunner

[57] ABSTRACT

A fluid pressure containment device utilizing a new design of pressure seal which accomplishes its purpose by a rotary motion of a tube placed inside a vessel. A helical slot cut into the tube causes the tube to rotate by the camming action of a free floating piston placed within the tube. The stationary outer vessel contains openings at its ends through which the working fluid medium may enter and exit and in addition is slotted, longitudinally for an attachment to the free floating piston to pass through the wall of the vessel as fluid pressure moves the piston longitudinally along the slot in the outer vessel. Sealing of the fluid pressure inside the stationary outer vessel is accomplished by the inside tube as it rotates and by a variety of seals which also serve as structural supports against pressure caused forces inside the tube.

More particularly, the present invention relates to an actuating cylinder, the type of which is used as a prime mover, translating pneumatic or hydraulic pressure in a fluid stream to force and movement.

4 Claims, 7 Drawing Figures

FLUID PRESSURE CONTAINMENT ACTUATOR

BACKGROUND OF THE INVENTION

Actuating cylinders commonly in use consist of a cylinder barrel which houses a movable piston and piston rod assembly. When pneumatic or hydraulic fluid pressure in a stream is applied to the cylinder barrel through a suitable port, the piston inside the cylinder barrel acts as a barrier to the fluid flow inside the barrel while fluid pressure directed to one side or other of the piston causes it and the piston rod to move. The piston remains within the confines of the barrel restrained by an end cap but the piston rod exits the cylinder barrel through the opening provided in an end cap. The free end of the piston rod may be attached to an exterior object that it is desired to move. The extended length of the device is, therefore, a column whose length equals the length of the cylinder plus the length of the cylinder rod protruding from the barrel.

Additionally, in the conventional actuating cylinder, a peripheral seal which is held by the end cap maintains fluid pressure inside the cylinder. The peripheral seal is the cause of high friction against the moving cylinder rod which results in seal wear and subsequent leakage of the fluid stream.

SUMMARY OF THE INVENTION

The arrangement of the present invention is a slotted stationary outer vessel similar in function to the cylinder barrel in a conventional cylinder whose function is to contain fluid pressure and elements of the assembly. Inside the slotted stationary vessel is a straight slotted tube which is hollow for the purpose of containing a spirally slotted hollow tube. The straight slotted hollow tube is made of a low friction bearing material which allows the spirally slotted tube within it to rotate freely within it while maintaining a closed path to fluid pressure. A piston within the spirally slotted tube is acted on by fluid pressure and when moving back or forth in the tube, by virtue of a camming action, causes the spirally slotted tube to rotate within the straight slotted tube. The piston is fitted with peripheral seals, which in conjunction with end seals contain fluid pressure within the assembly.

An attachment to the piston protrudes through the spiral slot in the outer vessel and may be attached to an external load for the purpose of performing useful work on that load. When viewed from the slotted side of the stationary vessel, the spiral slot in the rotating tube is visible for only a short section on either side of the piston. When pressure from the fluid stream moves the piston, the spiral groove, rotating, opens ahead of the piston and closes behind it by rotating down into the cylinder barrel maintaining a closed path to fluid pressure inside the pressure vessel.

It is the principal object of this invention to provide an actuating cylinder which eliminates the necessity of a piston rod and by this, shortens by almost half, the length of space required for emplacement of the cylinder in comparison to a cylinder, which does utilize a piston rod.

Another object of this invention is to provide a seal assembly which is not subject to high unit pressure and wear from friction.

Another object is to allow higher operating speeds of the piston by virtue of its reduced mass.

Another object is to provide an actuating cylinder whose length is not limited by columnar compressive forces as is the case with a cylinder with a cylinder rod.

Another object is to provide an actuating cylinder which produces equal force in both directions of movement.

Still another object is to produce an actuating cylinder whose weight is significantly less than that of a conventional cylinder which contains a cylinder rod.

These and other objects and advantages will become more apparent in the description and drawings which follow.

DESCRIPTION OF THE PREFERRED EMBODIMENT

Figure 1:
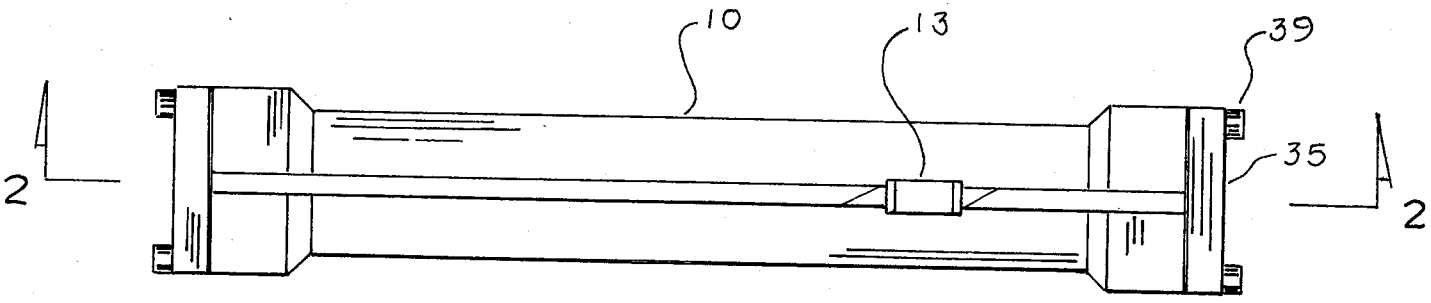
FIG. 1 is a side view of the actuating cylinder assembled.

In accordance with the accompanying drawings a structural vessel 10 houses a piston 11 affixed with spiral seals 12 and a load structural attachment 13, a spirally slotted tube 14, and a bearing seal tube 15. Structural vessel 10 has a straight slot 16 cut through one wall extending full length of the vessel. Load structural attachment 13, an integral part of piston 11, extends through straight slot 16 in structural vessel 10 and also through straight slot 17 in bearing seal tube 15 and moves longitudinally when piston 11 is caused to move.

Figure 2:
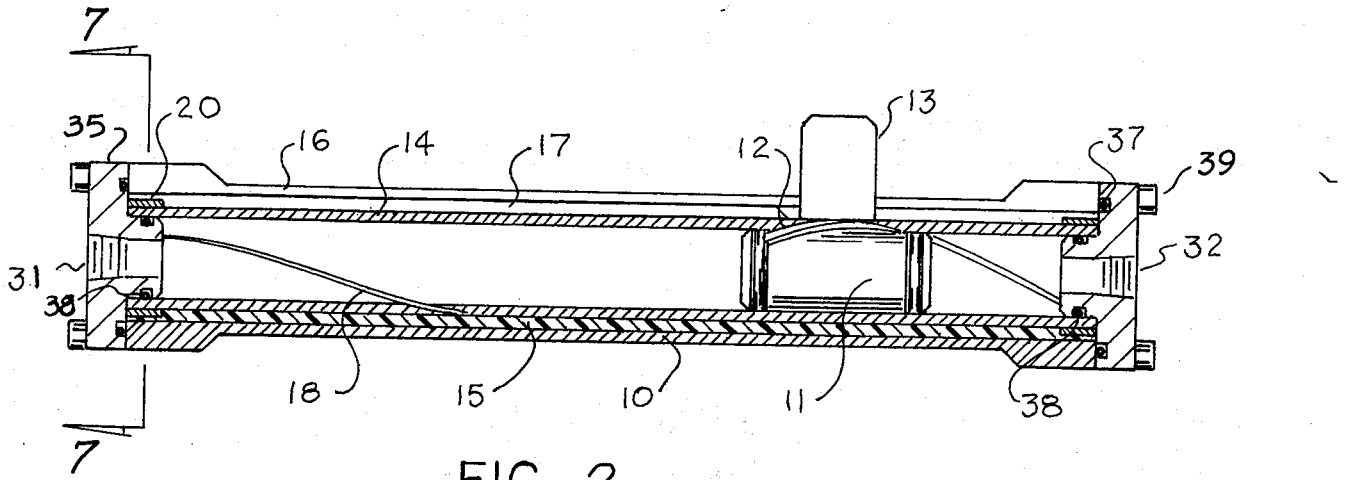
FIG. 2 is a sectional view taken along line 2—2 which is through the center of the cylinder.
Figure 7:
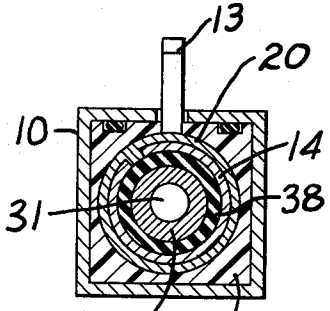
FIG. 7 is a cross-sectional view taken along line 4—4 of FIG. 2 depicting the concentric elements of the actuator.

Referring to FIGS. 1 and 2, spirally slotted tube 14 is supported by bearing seal tube 15 which allows spirally slotted tube 14 to rotate under the camming action of spiral seals 12 which are affixed to piston 11 as spiral seals 12 bear against the side walls of spiral slot 18 as piston 13 moves. Bearing seal tube 15 is constructed of a low friction polymer-Dupont Corporation Teflon which allows spirally slotted tube 14 to rotate freely under the camming action of spiral seals 12 while maintaining a tight fit against spirally slotted tube 14 and thereby maintaining a tight seal against fluid leakage. An internally keyed bushing 20, is placed over spirally slotted tube 14 at each end. As shown in FIGS. 2 and 7, keys of internally keyed bushings 20 fill spiral slot 18 for a short distance for the purpose of presenting a smooth sealing surface to end seals 38 as internally keyed bushing 20 rotates with spirally slotted tube 14.

Figure 3:
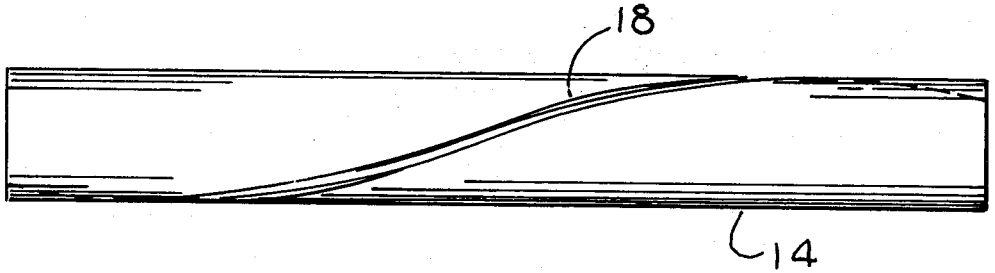
FIG. 3 is a view of the spirally slotted hollow tube removed from the actuating cylinder assembly.

Referring to FIG. 3 spiral slot 18, which is cut through one wall of spirally slotted tube 14, extends full length and progresses through an angle in excess of 270°, but less than 360° in order to insure that when piston 11 (FIG. 2) is at one end of structural vessel 10, spiral slot 18 will not be directly under either straight slot 16 in structural vessel 10 or directly under straight slot 17 in bearing seal tube 15 except in the area of piston 11, where spiral seals 12 will prevent fluid leakage from within spirally slotted tube 14 to atmosphere. Spiral slot 18 is cut to accommodate the width and bevel angle of spiral seals 12. Spirally slotted tube 14 is constructed of a high strength steel highly polished or chrome plated on its outside diameter.

Figure 5:
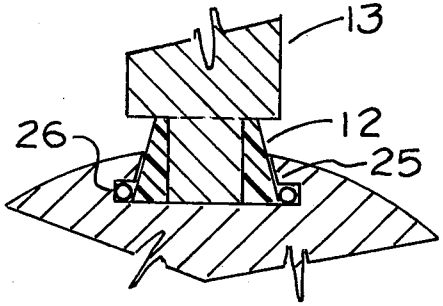
FIG. 5 is a cross sectional view taken along line 5—5 showing principally the seal which acts between the piston and the spirally slotted tube.
Figure 4:
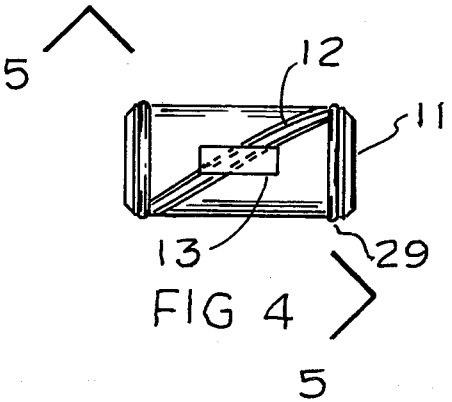
FIG. 4 is a view of the sliding piston sub-assembly removed from the actuating cylinder assembly.

Referring to FIGS. 4 and 5 spiral seals 12 are made of a low friction polymer and are inserted into dove tail grooves 25, which are formed to also retain linear seals 26. Spiral seals 12 are maintained in contact with piston 11 by the upper portion of structural attachment 13 which has not been undercut as has the lower portion. Assembly of spiral seals 12 is accomplished by sliding each spiral seal 12 into dove tail grooves 25 in and under the straight upper portion of structural attachment 13. This forces spiral seals 12 which were initially flat to conform to the spiral to match spiral groove 18. Linear seals 26 prevent fluid medium pressure which has entered under spiral seals 12 at the ends of spiral seals 12 from escaping to atmosphere. Circular seals 29, FIG. 4 act to exclude fluid medium which may be present in spirally slotted tube 14 from entering that portion of spirally slotted tube 14 which is occupied by piston 11.

Figure 6:
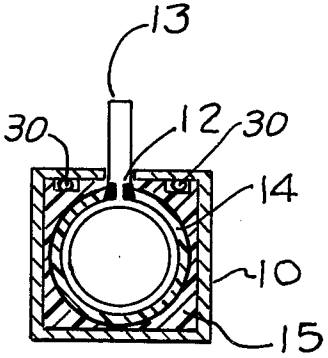
FIG. 6 is a cross sectional view taken along line 3—3 depicting the concentric elements of the actuator.

Referring to FIG. 6, when fluid pressure is applied, spirally slotted tube 14 expands into bearing seal tube 15 creating a diametrical barrier to fluid within spirally slotted tube 14 from escaping to atmosphere. Linear seals 30 will prevent fluid medium leakage from space that might exist between structural vessel 10 inner walls and outer surface of bearing seal tube 15. Spiral seals 12 will occupy the space between the lower portion of structural attachment 13 where it passes through spiral slot 18 in spirally slotted tube 14, creating a seal to fluid medium leakage in that area.

In operation, referring to FIG. 2, gas or hydraulic pressure in a fluid stream is applied through inlet port 31 and enters spirally slotted tube 14 bearing against piston 11 causing it to move. Fluid on the opposite side of piston 11 exits unpressurized through outlet port 32. When spirally slotted tube 14 is rotating spiral slot 18 opens ahead of load structural attachment 13 and close behind it as piston 11 moves in either direction. The portions of spiral slot 18 (ahead of and behind piston 11) which are visible through straight slot 16 in structural vessel 10 will contain spiral seals 12 which are also partly visible.

End caps 35 provide grooves for end cap seals 37 and 38 which prevent fluid medium leakage from inside spirally slotted tube 14 past the surfaces bounded by end caps 35 and structural vessel 10. End caps 35 also provide structural support against fluid pressure forces which tend to expand structural vessel 10. End cap screws 39 permit removal of end caps 35 and subsequent removal of elements of the assembly within structural vessel 10.

What I claim is:

1. A fluid power device for converting pressurized fluid into mechanical force, comprising:

(a) a vessel to contain a pressurized fluid, said vessel having extended through the surface thereof a longitudinal slot;

(b) a piston positioned within said vessel to move longitudinally with respect to said vessel in response to said pressurized fluid;

(c) a hollow tube having a spiral slot through the surface thereof, said tube positioned to rotate within said vessel to provide a continuous seal of said longitudinal slot except in one moveable contiguous area of said spiral slot and longitudinal slot; and (d) means passing through said moveable contiguous area of said longitudinal slot and spiral slot for attaching said moveable piston to a load exterior to said vessel, and said means for attaching including means for sealing said longitudinal slot at said moveable contiguous area.

2. The device of claim 1 wherein said means for sealing comprises a spiral seal mounted on said piston to engage said spiral slot.

3. The device of claim 1 further including bearing means for rotatably supporting said hollow tube in said vessel.

4. The device of claim 3 wherein said bearing means comprises a bearing seal tube of low friction polymer having a longitudinal slot aligned with said vessel longitudinal slot.

* * * * *